United States Patent [19]

Durand

[11] 4,172,418

[45] Oct. 30, 1979

[54] ELECTROSTATIC PRINTING APPARATUS AND METHOD

[75] Inventor: David Durand, Bristol, R.I.

[73] Assignee: Freeman Transfer Printing Company, Inc., East Providence, R.I.

[21] Appl. No.: 902,099

[22] Filed: May 1, 1978

[51] Int. Cl.[2] ..... B41M 1/20; B41M 5/26; B41N 1/12; B41F 1/06

[52] U.S. Cl. ..... 101/194; 8/2.5 A; 101/DIG. 13; 101/211; 101/379; 101/383; 101/395; 101/401.1; 101/470

[58] Field of Search ..... 101/470, DIG. 13, 211, 101/379, 383, 395, 401.1; 8/2.5 A

[56] References Cited

U.S. PATENT DOCUMENTS

| | | | |
|---|---|---|---|
| T957,001 | 4/1977 | Chitwood | 8/2.5 A |
| 1,744,829 | 1/1930 | Dreyfus | 101/470 |
| 2,357,809 | 9/1944 | Carlson | 101/DIG. 13 |
| 2,726,940 | 12/1955 | Buhle | 355/6 |
| 3,620,881 | 11/1971 | Kannegiesser | 101/470 |
| 3,983,801 | 10/1976 | Watanabe et al. | 101/DIG. 13 |
| 4,018,557 | 4/1977 | Glover | 101/470 |
| 4,059,471 | 11/1977 | Haigh | 8/2.5 A |
| 4,121,932 | 10/1978 | Ishida | 101/470 |

FOREIGN PATENT DOCUMENTS

| | | | |
|---|---|---|---|
| 51-106445 | 9/1976 | Japan | 101/470 |
| 1211149 | 11/1970 | United Kingdom | 101/470 |
| 1243223 | 8/1971 | United Kingdom | 8/2.5 R |

OTHER PUBLICATIONS

Western Advertising, Apr. 24, 1961, p. 16, by Giesecke.

*Primary Examiner*—Clyde I. Coughenour
*Attorney, Agent, or Firm*—Salter & Michaelson

[57] ABSTRACT

A method and apparatus for effecting sublimation printing of a substrate wherein a matrix comprising the design to be printed is electrostatically charged in a given polarity and then a fine disperse dye powder, oppositely charged, is brought into contact with said matrix wherein the charged matrix attracts the oppositely charged dye particles to effect coating of the matrix with the dye, after which the coated matrix is moved into registry with the substrate to be printed, and specifically in overlying relation with respect to a surface of the substrate that has been coated with a dye receptive coating, after which the matrix is brought into pressurized contact with the coated surface of the substrate to cause sublimation of the dye pattern into said coated substrate surface.

5 Claims, 8 Drawing Figures

ELECTROSTATIC PRINTING APPARATUS AND METHOD

BACKGROUND AND SUMMARY OF THE INVENTION

The present invention relates generally to sublimation printing and is particularly concerned with an electrostatic method and apparatus for effecting such printing.

Printing through the use of sublimatible dyes is known and is rapidly becoming a much utilized process. Generally, the system involves the use of crystalline dye materials which will sublimate, that is, change from a solid to a gaseous phase without becoming liquid. These crystals are ground or pulverized to a fine particle size and then incorporated into a vehicle, such as water, so as to suspend and disperse the dye particles in such a manner so as to form an ink suitable for printing on a paper transfer sheet. The transfer sheet may be imprinted with such inks or by any known commercial process to form the desired image or design in one or more colors. Thereafter, the transfer sheet is placed with its image side against a substrate having a dye receptive surface, such as a urea melamine coating. The sheet and surface are then heated and a thermodynamic equilibrium is set up between the transfer sheet and the receptive surface which is to receive the imprinted design. The time required for effective equilibrium and thus effective transfer to occur is dependent upon known factors including the particular type of receptive coating, the dye concentration, the air gap between the sheet and surface, and the temperature of the various components. The dyes then sublimate into the surface where they condense to form the desired image on the article surface. A particular apparatus and method relating to the field of sublimation printing is disclosed and described in my copending U.S. patent application Ser. No. 895,229, filed Apr. 10, 1978.

It has now been found desirable to provide a paperless system utilizing the sublimation printing technique. This is accomplished by utilizing a powder coating technology, and specifically, by the utilization of electrostatic means for effecting the coating of a matrix with a finely ground disperse dye powder after which the coated matrix is brought into pressurized contact with the substrate to be printed, wherein sublimation of the desired image or pattern into the substrate is achieved, the substrate being coated with a dye receptive layer to receive the image, as is known in the art.

The utilization of electrostatic means for the application of paints has been known for many years, but the development of electrostatic spraying of powders is more recent, and the development of this technology has been somewhat slow due to the unavailability of suitable, inexpensive plastic powders. One method of applying powders that has been utilized to some extent is the so-called electrostatic fluidized bed process in which the powder resin is applied to a heated object in an open top container. The resin is mixed with compressed air to form a fluid liquid-like mass. The object to be coated is heated above the melting point of the powdered resin and is then immersed into the fluid bed. The resin melts on contact with the heated object to form a coating, and the higher the object is heated and the longer it is immersed in the bed, the thicker the coating. This technique is advantageous in that very thick coatings can be applied in one operation and also parts with blind holes and odd configurations can be coated relatively easily and effectively at a relatively low cost.

In the electrostatic powder spraying process with which the instant invention is concerned, an electrostatic charge is applied to finely ground disperse dye powder, which charged powder is brought into contact with an oppositely charged matrix constructed of a conductive compound so as to be receptive to an electrical charge, whereupon the oppositely charged powder is attracted to the matrix so as to coat same. The coated matrix is then brought into registry with the particle or substrate to be printed, said substrate having a dye receptive coating thereon. The matrix is then forced into pressurized contact with the coated surface of the substrate so as to effect sublimation of the dye pattern into the coated surface of the substrate. This system is particularly applicable to the printing of rigid surfaces, such as hardboard, although not limited thereto. Also, as is true in all powder coating technology, a decided advantage is elimination of solvent carriers necessarily present where transfer paper is being utilized, it being understood that the absence of solvents eliminates the emission of fumes and vapors thereby providing an environment that is virtually free of pollutants. Safety standards are also improved because the hazard of fire is substantially reduced.

Another advantage that results from the use of the powder coating technology of the present invention is the ability to apply dye stuffs which could not be applied by other techniques without difficulty. This is because of the insolubility of some dye stuffs in most solvents. Therefore, many new and different dye stuffs can be applied by powder coating techniques.

Another important feature of the present invention is the fact that the disperse dye powder that is utilized in the system is almost completely used. Expressed differently, excess powder in the system is recirculated and subsequently used, to the extent that approximately 98 percent of the powder supply is effectively used.

Other features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
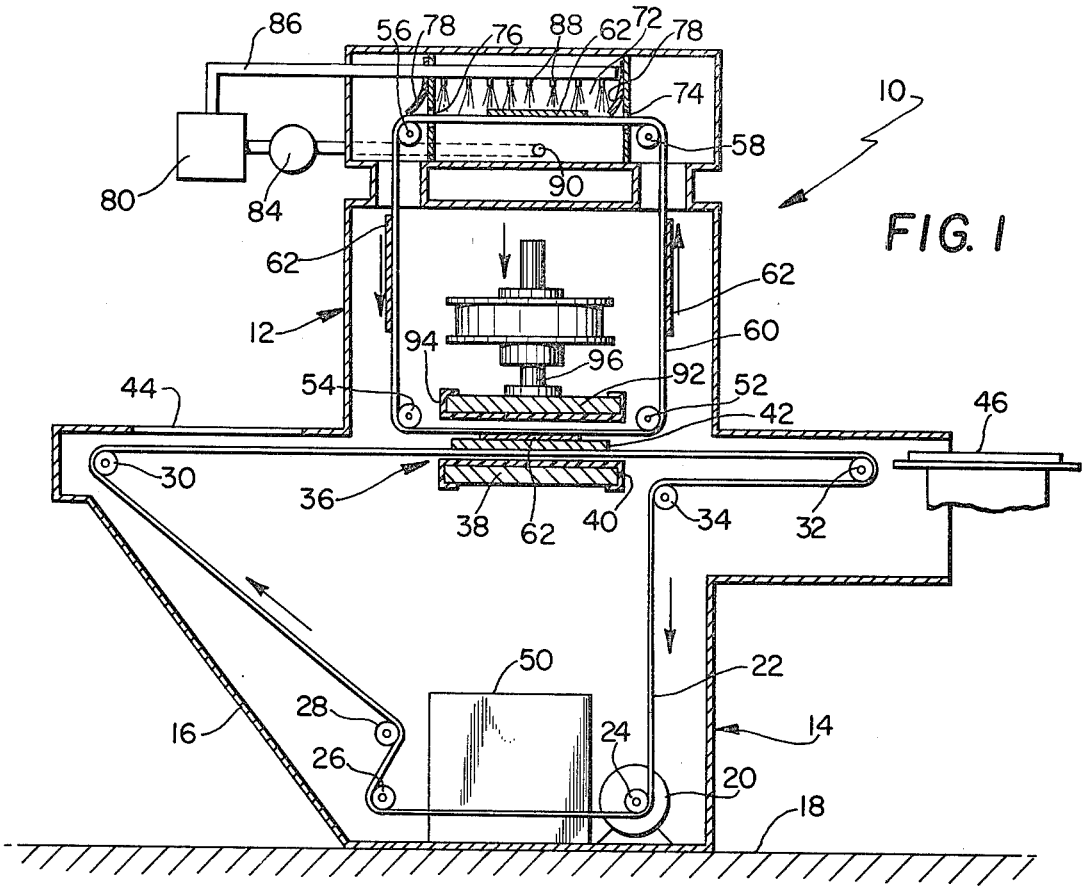
FIG. 1 is an elevational view, in section, showing the apparatus of the present invention.
Figure 2:
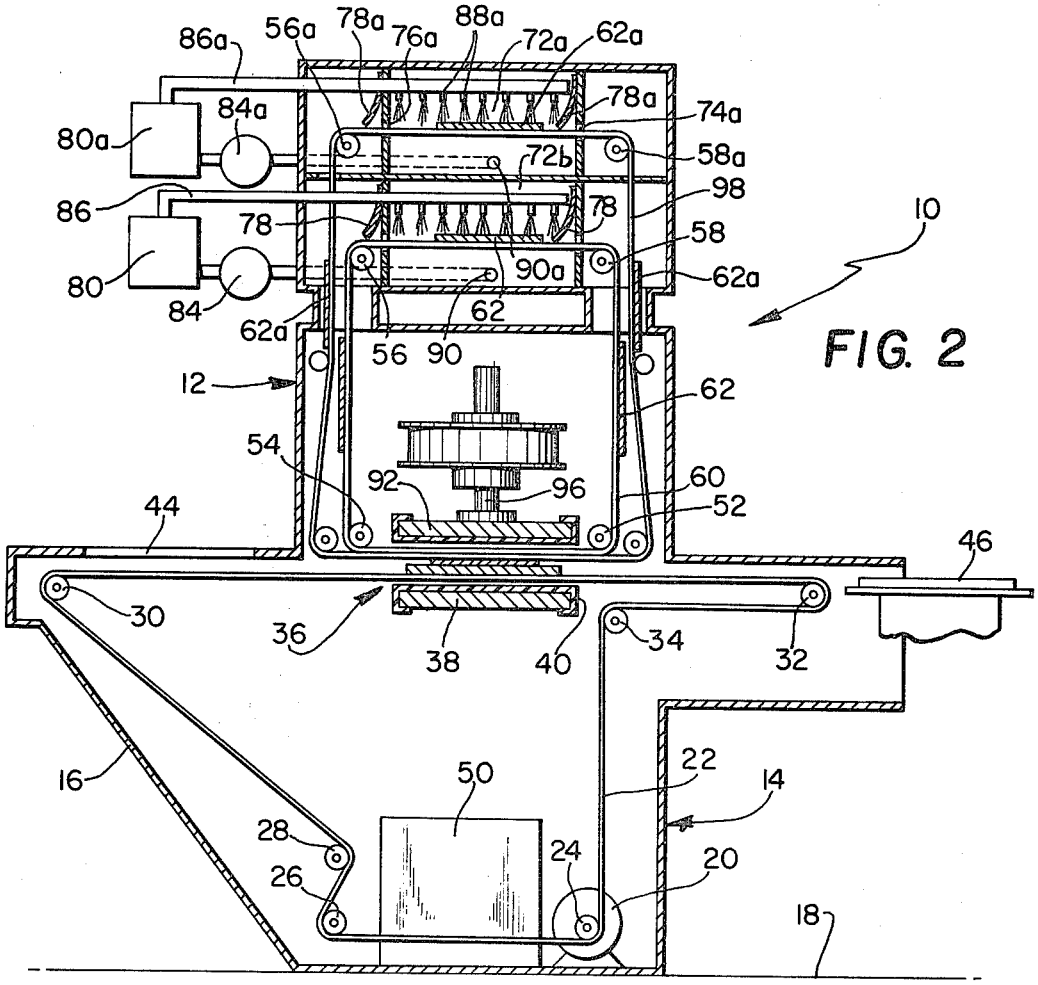
FIG. 2 is an elevational view, in section, of a slightly modified form of apparatus.

Referring to the drawing, and more particularly to FIG. 1, there is shown a printing apparatus 10 comprising an upper housing 12 and a lower housing 14. The lower housing 14 comprises a pedestal portion 16 adapted to rest on any suitable support surface 18, said pedestal portion having therein a motor 20 which drives an endless belt or conveyor 22, the belt 22 being driven by drive roller 24 and passing over idler rollers 26, 28, 30, 32, and 34. The portion of the belt between rollers 30 and 32 extends horizontally through a print station 36 comprising a fixed lower platen 38, Teflon coated as at 40. The belt 22 is adapted to receive a hardboard sheet 42, said hardboard sheet being deposited on the belt 22, as through opening 44, it being apparent that the hardboard sheet is then carried by the belt or conveyor 22 to print station 36 where the hardboard is sublimation printed, as will be hereinafter described in detail. After printing, the belt 22 carries the printed hardboard away from the print station where it is deposited on a stacking table 46.

Figure 7:
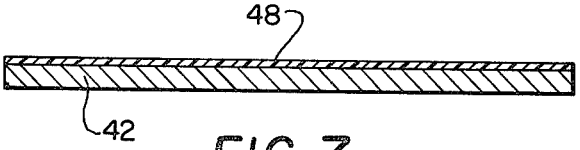
FIG. 7 is cross-sectional view, on an enlarged scale, of the substrate utilized in the present invention.

The hardboard sheets may be of any desired size or configuration, and preferably are coated with a white ground coat and a urea melemine top coat 48, see FIG. 7, in order to provide a coating that is receptive to dye sublimation. The preferred thickness of the urea melamine top coat 48 is approximately 1 mil.

The lower housing 14 also has therein an electrostatic generator 50, the purpose of which will hereinafter become apparent.

The upper housing 12 has mounted therein a plurality of guide rollers 52, 54, 56 and 58 around which a flexible chain belt 60 extend, it being noted that the path of the chain belt 60 defines a rectangular configuration. It will be understood that drive means, not shown, interconnect the chain belt 60 and motor 20 so that the former is driven by the latter through its aforesaid rectangular path. For example, a chain or belt drive, not shown, may interconnect the motor 20 to one of the rollers 52, 54, 56, or 58 so as to achieve the desired movement of chain belt 60, which movement is in a counter-clockwise direction, when viewing FIG. 1.

Figure 3:
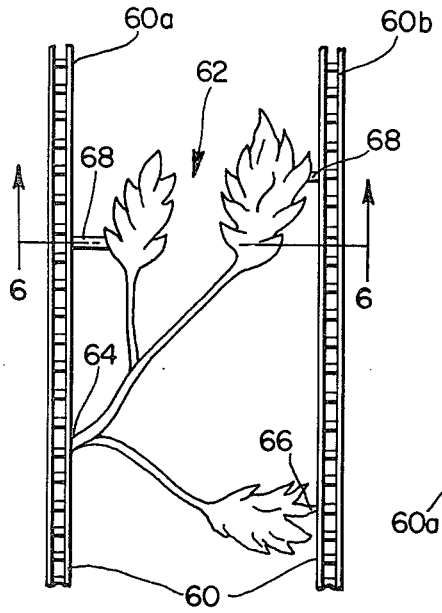
FIG. 3 is a fragmentary plan view of the matrix and supporting chain belt that forms a part of this invention.
Figure 4:
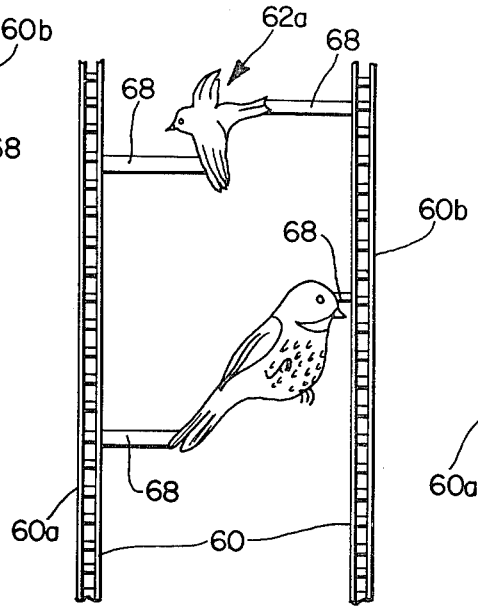
FIGS. 4 and 5 are views similar to FIG. 1, except that they show matrixes having different designs.
Figure 5:
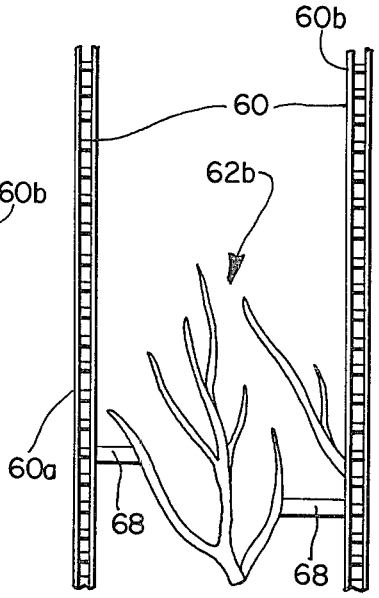
Figure 6:
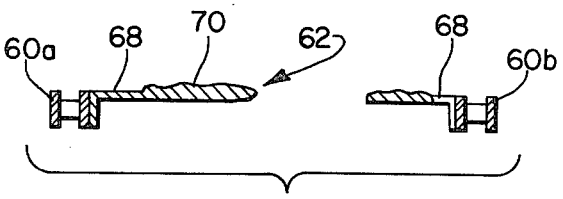
FIG. 6 is a section, on an enlarged scale, taken on line 6—6 of FIG. 3.

Attached to the chain belt 60 at spaced locations therealong, and preferably at four equi spaced locations, are cast silicone matrixes 62, each of which has been impregnated with aluminum particles of a relatively minute size (approximately 2 microns) whereby the impregnated silicone becomes an electrically conductive compound. It will be understood that although the aforesaid silicone and aluminum particles have proven to be effective in use, other suitable plastics and conductive particles could be used. The matrixes 62 may embody any desired ornamental design, and examples of such designs are illustrated in FIGS. 3 through 5. Specifically, the matrixes are positioned between the spaced edge portions 60A and 60B of belt chain 60 and are secured to the chain belt, either directly, where the designs extend into engagement with the chain portions, as at 64 and 66 in FIG. 3, or where the design is inwardly spaced from the chain portions, it is supported by connecting legs 68. The printing surface of the matrixes 62 is that which faces outwardly from the belt 60, and as will be seen most clearly in FIG. 6, the working or outwardly disposed surface 70 may be uneven or contoured, while the supporting legs 68 are somewhat recessed or set back from said surface 70.

Located near the top extremity of upper housing 12 is an enclosed electrostatic dye chamber 72 having entrance and exit openings 74, 76, respectively, through which belt 60 passes so as to sequentially carry matrixes 62 into and out of said chamber. Flap means 78 are provided adjacent said entrance and exit openings so as to maintain said chamber sealed closed as much as possible. Associated with the chamber 72 is a dye reservoir 80 containing a supply of extremely fine disperse dye particles (approximately ½ micron in size) of any desired color, such as, for example, Resiren Blue T-GL (trademark of Verona, division of Mobay Chemical). Pump means 84 force the disperse dye particles through conduit 86 into the chamber 72 where they exit under pressure through jets or nozzles 88 so as to impart an extremely fine pressurized spray of disperse dye particles upon the matrix 62 located in the chamber 72. Conventional wiring (not shown) is employed whereby the electrostatic generator 50 imparts an opposite electrostatic charge to the disperse dye particles entering the chamber 72, as by charging the nozzles 88. Thus, if the electrostatic generator has imparted a positive charge to the matrixes 62, than a negative charge is imparted to the nozzles 88, whereupon the powder passing therethrough will likewise be negatively charged. Conversely, if the matrixes 62 are positively charged, then the nozzles 88 are negatively charged so that the powder passing therethrough will likewise be negatively charged. When the electrically charged disperse dye particles enter the chamber 72, they are attracted to the oppositely charged matrix 62 whereupon the latter becomes completely coated with the dye particles. Excess dye particles in the chamber 72 are exhausted through outlet conduit 90 for recirculation back to reservoir 80.

The coated matrix is then carried by the belt 60 to print station 36 where it is positioned in registry with the hardboard 42 to be printed. At this point an upper platen 92, Teflon coated as at 94, is moved downwardly, as by hydraulically controlled ram 96, to force matrix 62 against the coated surface of hardboard 42, preferably at a pressure of approximately 4 pounds per square inch for a time period of approximately 8–10 seconds to cause sublimation of the dye pattern into the coated surface of the hardboard. Since the working surface of the matrix 62 may be uneven or contoured, varying intensities of color will automatically be achieved throughout the design. At the same time, since the supporting legs 68 are recessed or set back with respect to the working surface 70 of matrix 62, contact will not be made between the supporting legs and the hardboard, whereupon any dye particles that have coated the supporting leg will not be transferred to the hardboard during the printing process. Suitable means (not shown) may be employed for imparting such heat (approximately 410° F.) to the platens 92 and/or 38 as may be necessary to achieve most effective sublimation of the dye pattern into the surface of the hardboard 42, such as, for example, the general type of heating means disclosed in my aforesaid copending application Ser. No. 895,229.

In order that the electrostatic charging of the matrixes 62 and the nozzles 88 may be most effectively accomplished, and in order that there be no electrical interference with such charging, the chamber 72, that is, the surrounding walls that define the chamber, are preferably constructed of a material that is electrically nonconductive.

Where a single color pattern is being sublimated into the hardboard 42, it will be understood that all of the matrixes 62 shown in FIG. 1 will be identical, it being understood that four complete printing operations will be achieved when the belt 60 has moved once through its entire path. Expressed differently, greater production is achieved by having a plurality of matrixes on the belt 60 whereupon as one matrix is at the printing station, another matrix will be in the electrostatic dye chamber, etc. Of course, hardboards 42 must be sequentially fed to the belt 22 through the opening 44 so that each time a matrix is at the printing station, a hardboard will likewise be there to be printed.

With minor variations, the apparatus of FIG. 1 may be modified to achieve multicolored printing. For example, if it is desired to print a pattern embodying the leaves of FIG. 3 and the birds of FIG. 4, and if it is desired that the leaves be green and the birds red, for example, separate electrostatic dye chambers 72*a* and 72*b* are provided, said dye chambers being identical in all respects with the aforedescribed dye chamber 72. The matrixes 62 are carried by belt 60 into chamber 72*a*, which chamber receives disperse dye particles of a green color. At the same time, belt 98 carries matrixes 62*a* into the dye chamber 72*b* to which disperse dye particles of a red color are introduced. Thus, the matrixes 62 are electrostatically coated with green disperse dye particles, while matrixes 62*a* are electrostatically coated with red disperse dye particles. The operation is such that the coated matrixes 62 and 62*a* are in registry at the print station 36 whereupon when the platen 90 descends, the matrixes 62 and 62*a* are simultaneously forced into contact with the coated hardboard 42 so as to effect the desired sublimation printing therein. More specifically, the pattern of matrix 62 will be sublimated in green into the hardboard, while the pattern of matrix 62*a* will simultaneously be sublimated in red into the hardboard. It will be noted that the patterns of 62 and 62*a* do not overlap at any point, that is, the birds of matrix 62*a* do not overlap or cross the leaves of matrix 62 or vice versa. This permits a composite design to be achieved wherein each of the separate colors is clear and distinct throughout its respective pattern. The flexibility of the belts 60 and 98, and the pliability of the matrixes 62, 62*a* permit the platen 92 to simultaneously force both of the matrixes into contact with the hardboard even though it is obviously necessary that the bottom rollers of one of the belts be slightly elevated with respect to the bottom rollers of the other belt since one of the belts and its respective matrix must obviously be located over the other at the print station in order to achieve the desired registry.

Figure 8:
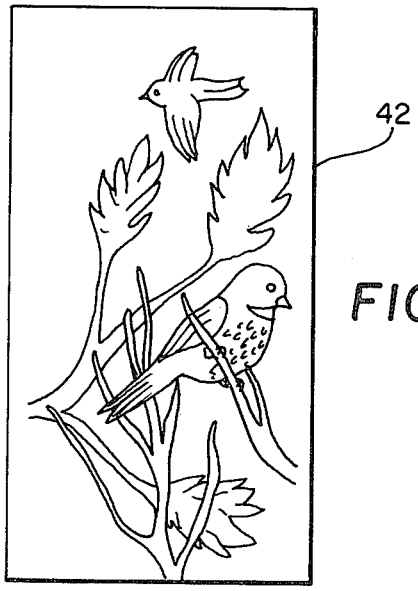
FIG. 8 is a front view of the printed substrate.

In some situations it may be desired to print a pattern that is not only multicolored, but also that has overlapping portions, such as the pattern illustrated in FIG. 8, which is actually a combination of the patterns shown in matrixes 62, 62*a* and 62*b*. Since the design of matrix 62*b* overlaps portions of the designs of matrixes 62 and 62*a*, it is not possible to effect the printing of matrix 62*b* at the same time that matrixes 62 and 62*a* are simultaneously being transferred to the hardboard. In such a situation, a third electrostatic dye chamber (not shown) would have to be provided for receiving the matrix 62*b*, which dye chamber would receive disperse dye particles of the particular color desired for the design of matrix 62*b*. At the same time, the matrix 62*b* would have to be properly staggered with respect to the registered matrixes 62 and 62*a* so that after the latter two matrixes have simultaneously performed their printing operation, they would move away from the printing station and than matrix 62*b* would enter the printing station and be forced into contact with the hardboard 42 to finalize the printed design. Thus, the hardboard 42 would be at the printing station when the ram 96 and platen 92 descend to force the matrixes 62 and 62*a* simultaneously into printing contact with the hardboard, after which the platen 92 would raise and the matrixes 62 and 62*a* would move away from the printing station, with the hardboard remaining at said station. When the matrix 62*b* has moved into registry with the hardboard, the platen 92 again descends to effect the desired sublimation of the pattern of matrix 62*b* into the hardboard, thus completing the printing thereof.

Although this invention is of prime utility in connection with the printing of rigid materials, such as hardboard, it will be understood that the invention is not limited to such usage, but rather this electrostatic method and apparatus may also be utilized for the printing of flexible materials, such as textile fabrics, or the like. In either case, the system is not only paper-less, i.e., no transfer paper is utilized, but it is also substantially a pollution-free system, since no solvent carriers are utilized, thus eliminating the emission of potentially dangerous fumes and vapors. Not only is this an ecological advantage, but also safety standards are improved, because the hazard of fire is substantially reduced. Also, the electrostatic system utilized lends itself to the coating of relatively complex designs and patterns and relatively fast production rates can be achieved. Perhaps one of the most significant advantages, however, of the present invention is the fact that the disperse dye particles not actually sublimated are reclaimed and recirculated for subsequent usage, to the extent that approximately 98 percent of the powder is effectively used.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Electrostatic dye apparatus comprising a substantially enclosed electrostatic dye chamber, a print station, a flexible matrix of an electrically conductive compound, means conveying said matrix into said chamber and then to said print station, means introducing a supply of finely powdered disperse dye to said chamber, means imparting an electrostatic charge to said dye powder and an opposite electrostatic charge to said matrix whereby as said charged matrix passes through said chamber, the oppositely charged powder is attracted to said matrix to effectively coat same, means at said print station supporting a substrate having a dye receptive coating on the surface of said substrate to be printed, and means at said station forcing said coated matrix into engagement with said substrate coated surface and for applying heat thereto whereby the dye coating of said matrix is transferred by sublimation into the surface of said substrate, said matrix conveying means comprising a belt having spaced edge portions, said matrix being connected to said spaced edge portions and located therebetween, said matrix defining an ornamental design which occupies only a portion of the space between said edge portions.

2. In the apparatus of claim 1, said matrix being of a cast plastic material impregnated with electrically conductive particles.

3. In the apparatus of claim 1, the surface of said matrix which contacts said substrate being slightly contoured, whereby variations in color intensity are achieved in the printed substrate.

4. The apparatus of claim 1 further characterized in that a plurality of different design matrixes are provided, a separate electrostatic dye chamber for receiving each different matrix with a different color dye introduced to each chamber whereby each different design matrix is electrostatically coated with a different color dye, said conveying means being operative to bring said different coated matrixes to said print station at the same time and in registered overlying relation, whereby said forcing means simultaneously forces said matrixes against said substrate to achieve sublimation of a multi-color design therein, said different design matrixes being substantially offset with respect to each other when in overlying registry at said print station, whereby each design may be simultaneously printed on said substrate.

5. The method of sublimation printing a multi-color ornamental design into a substrate having a dye receptive coating on one surface thereof, comprising the following steps:

(a) forming a matrix of a flexible electrically conductive material;

(b) applying one electrostatic charge to said matrix of a first polarity;

(c) spraying said matrix with a disperse dye powder that has been electrically charged with an opposite polarity to that of said matrix whereby said powder clings to said matrix and coats same;

(d) repeating steps (a) through (c) using a different design matrix and a different color dye powder;

(e) aligning said coated matrixes in registered overlying relation with said substrate with the designs of each matrix being substantially offset with respect to each other; and (f) simultaneously forcing said matrixes into pressurized contact with the coated surface of said substrate to sublimate a composite multi-color design therein.

* * * * *